US006905042B2

(12) United States Patent
Eberhardt et al.

(10) Patent No.: US 6,905,042 B2
(45) Date of Patent: Jun. 14, 2005

(54) TANK FOR HOLDING AN OPERATING MEDIUM

(75) Inventors: Maximilian Eberhardt, Esslingen (DE); Georg Becker, Schwaikheim (DE); Jürgen Háberlein, Murrhardt (DE)

(73) Assignee: Andreas Stihl AG & Co., Waiblingen (DE)

( * ) Notice: Subject to any disclaimer, the term of this patent is extended or adjusted under 35 U.S.C. 154(b) by 393 days.

(21) Appl. No.: 10/144,848

(22) Filed: May 15, 2002

(65) Prior Publication Data

US 2002/0170523 A1 Nov. 21, 2002

(30) Foreign Application Priority Data

May 21, 2001 (DE) ..... 101 24 621

(51) Int. Cl.[7] ..... B65D 90/12

(52) U.S. Cl. ..... 220/562; 220/4.14

(58) Field of Search ..... 220/562, 4.14, 220/4.12, 4.21, 4.13; 30/276

(56) References Cited

U.S. PATENT DOCUMENTS 4,841,929 A * 6/1989 Tuggle et al. ..... 123/198 E
5,896,669 A * 4/1999 Uhl ..... 30/383

* cited by examiner

*Primary Examiner*—Stephen Castellano
(74) *Attorney, Agent, or Firm*—Walter Ottesen

(57) ABSTRACT

The invention relates to an operating medium tank (1) for a drive unit (2), especially for an internal combustion engine (3) of a portable handheld work apparatus. The tank (1) has a fill opening (4) and a output opening (5) in the housing wall (6) of the tank. According to the invention, at least one base (7) having a lug (8) is formed as one piece from the housing wall (6) in order to configure the tank so as to be operationally safe and easy to assemble. The tank (1) can be fixed with the aid of the lug (8) so as to be form-tight and separable on a receptacle (9) of the drive unit (2).

20 Claims, 4 Drawing Sheets

TANK FOR HOLDING AN OPERATING MEDIUM

FIELD OF THE INVENTION

The invention relates to a tank for holding an operating medium for a drive unit, especially for an internal combustion engine of a portable handheld work apparatus.

BACKGROUND OF THE INVENTION

Tanks for holding an operating medium are known for holding operating substances such as oil or fuel which function to supply a work tool with oil or to supply fuel to an engine. A tank for an operating medium for an internal combustion engine of a portable handheld work apparatus is blown as one piece from plastic and has a fill opening and an output opening for the operating medium. The operating medium tank is provided with assembly openings for mounting on the drive unit. Attachment elements for connecting the tank to the drive unit are guided through the assembly openings. In an operating medium tank, the assembly on the drive unit is made difficult especially because of a lack of adjusting devices. In addition, the danger is present that the operating medium tank will develop a leak because of possible fractures of the assembly openings.

SUMMARY OF THE INVENTION

It is an object of the invention to provide a tank for an operating medium for a drive unit which is operationally safe while being simple to manufacture and which can be easily mounted.

The operating medium tank of the invention is for a drive unit including an internal combustion engine of a portable handheld work apparatus. The operating medium tank includes: a housing having a housing wall defining an interior for the operating medium; the housing wall having a fill opening and an output opening formed therein; a base on the housing wall and a lug extending from the base; the base and the lug formed as one piece from the housing wall; a receptacle on the drive unit; and, means for releasably fixing the tank with the lug to the receptacle so as to permit the tank to be mounted form-tight on the drive unit.

The operating medium tank is easily mounted because a preferably full wall base having a lug is formed as one piece therewith and, with the aid of the lug, the tank can be releasably fixed on a receptacle of the drive unit.

When a tear or fracture of the lug occurs during manipulation of the operating-medium tank, a blow causing a leak of the tank is virtually avoided because the base of the lug prevents the housing wall of the tank from breaking open. This is effected by an especially stiff and flat connection of the base to the tank or also via a configuration of the base in the form of a set break location between the lug and the housing wall. The operating medium tank can be fixed between two housing parts of the drive unit which enclose the operating medium tank. The lug functions for a preassembly of the operating medium tank to the drive unit; whereas, the housing parts of the drive unit hold the operating medium tank.

The operating medium tank is advantageously fixed between the housing parts of the drive unit. The housing parts partially or completely surround the operating medium tank. The housing parts are supported directly on the housing wall of the operating-medium tank. An outwardly projecting holding arm is formed on the housing wall of the operating medium tank in accordance with an advantageous embodiment thereof. It is advantageous to provide several holding arms (preferably two holding arms) which are so configured that they each extend as one piece from the housing wall in order to connect the operating medium tank at several defined locations with the drive unit. The holding arms are so arranged with respect to a longitudinal center axis of the operating medium tank that the holding arms lie approximately in planes which pass approximately perpendicularly through the longitudinal center axis of the operating medium tank. The holding arms, especially the ends of the holding arms, lie form-tight between the housing parts of the drive unit. The operating medium tank can, in this way, be preassembled in the receptacle of the drive unit with the aid of the lug. Thereafter, the operating medium tank is clamped or in another manner fixed with the holding arms between the housing parts of the drive unit.

Preferably, the housing parts are engine housing parts such as a crankcase made of light metal or plastic and a starter housing cover. It is advantageous to provide radial play between the lug and the receptacle in order to compensate for the play between the lug and the receptacle and for the clamp-free fixing of the operating medium tank to the drive unit. To compensate for the play, a damping element made of elastic material can be mounted radially between the lug and the receptacle. The damping element is provided as a sleeve-shaped component and is pushed over the lug and preferably has a thickening at the base end of the lug. The damping element can be produced by spraying on and securing an elastic mass on the lug. In this way, the lug is axially and radially damped with respect to the receptacle and is held in a clamp-free manner.

If the assembly direction of the operating medium tank is selected in approximately the direction of a longitudinal center axis of the tank, then it is practical to mount the lug at a spacing radially to the longitudinal center axis and preferably also the housing wall of the tank. For an improved form-tight preassembly of the operating medium tank, two or more lugs are formed from the housing wall with these lugs having longitudinal axes preferably approximately aligned parallel to each other.

The operating medium tank is made of thermoplastic synthetic material such as polyamide in order to make possible an adequate length of the lugs. Preferably, the operating medium tank is produced from a first half shell and a second half shell. The half shells are manufactured as injection molded parts or pressed parts and are connected to each other material-tight, force-tight or form-tight by gluing, frictional welding or in other suitable types of connection. When manufacturing the half shells in the injection molding or press process, it is possible to form sufficiently long lugs on a half shell as one piece therewith.

In a preferred embodiment of the operating medium tank, the holding arms are arranged on the first half shell and the lugs on the second half shell. In order to avoid a possible overstressing of the operating medium tank (the tank could tear and develop a leak at the lugs and holding arms), it is practical to configure the base, that is, the component between housing wall and lug, as a predetermined break location.

The operating medium tank is preferably utilized as a fuel tank for a drive unit of a portable handheld work apparatus such as a brushcutter, cutoff machine, motor-driven chain saw or the like. The drive unit is configured as a two-stroke or four-stroke internal combustion engine.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
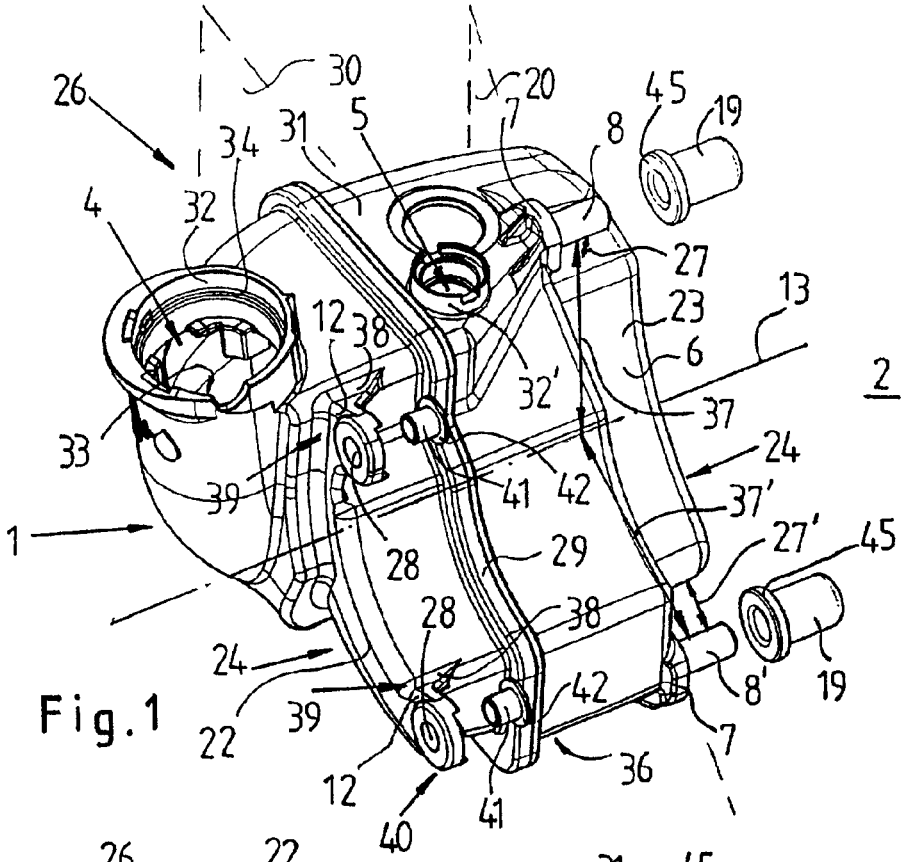
FIG. 1 is a perspective view of an operating-medium tank according to the invention.
Figure 7:
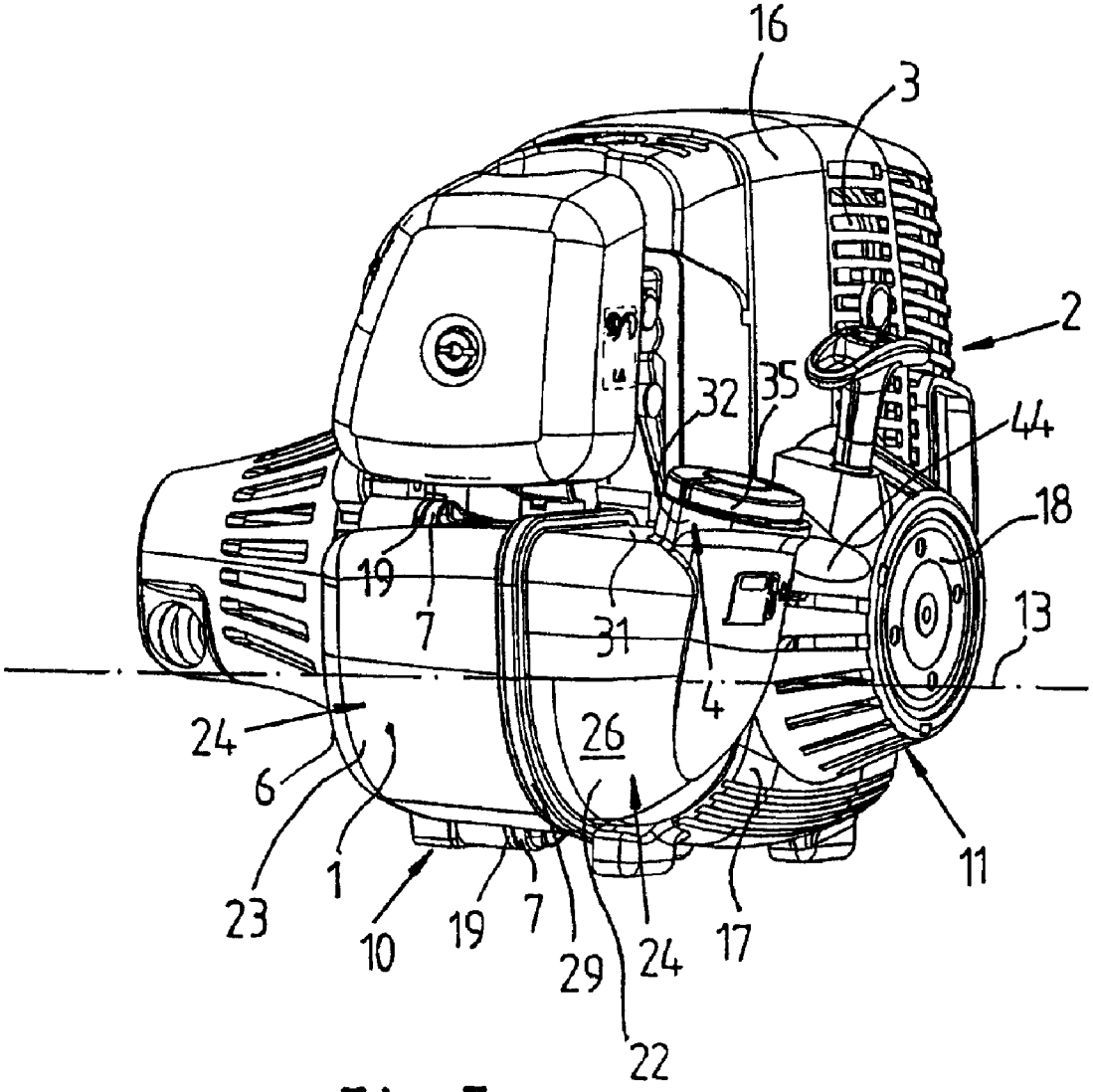
FIG. 7 is a perspective view of the tank on an internal combustion engine of a portable handheld work apparatus.

FIG. 1 shows a perspective view of an operating medium tank 1 for a drive unit 2 shown in FIG. 7. The drive unit 2 is an internal combustion engine 3 for a portable handheld work apparatus. The operating medium tank 1 is suitable as a store for an operating medium such as oil, fuel or the like.

The operating medium tank 1 functions as a fuel tank 26 in the embodiment shown and is for a two-stroke internal combustion engine 3 of a brushcutter (see FIG. 7). The operating medium tank 1 is essentially manufactured as a two-part plastic component comprising a first half shell 22 and a second half shell 23 manufactured in accordance with an injection-molding process. The two half shells 22 and 23 are joined via friction welding, adhesive or fusion along an abutting interface 29. The abutting interface 29 lies in a plane 30 running transversely to a longitudinal center axis 13. The operating medium tank 1 is a hollow body having a tight housing wall made of thermoplastic synthetic material such as polyamide. The hollow body has a kidney-like shape when viewed in cross section and is approximately of a rectangular shape when viewed in plan.

Two circularly-shaped openings are provided at the upper end 31 of the tank 1, namely, a fill opening 4 and an output opening 5. The fill opening 4 has an inner diameter approximately twice as large as the inner diameter of the output opening 5. Both openings are surrounded by collars (32, 32') which each project from the upper end 31 of the tank 1. The collar 32 of the fill opening 4 has a thread 34 on the inner side 33 thereof for fixing a tank cap 35 (see FIG. 7).

Figure 3:
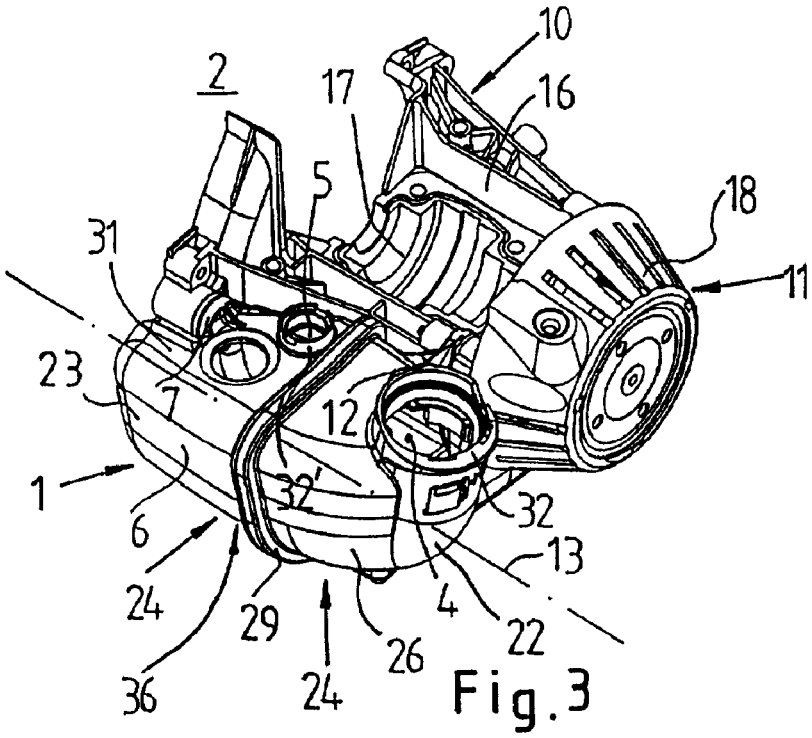
FIG. 3 is a perspective view of the operating medium tank which is fixed between two housing parts of a drive unit.
Figure 4:
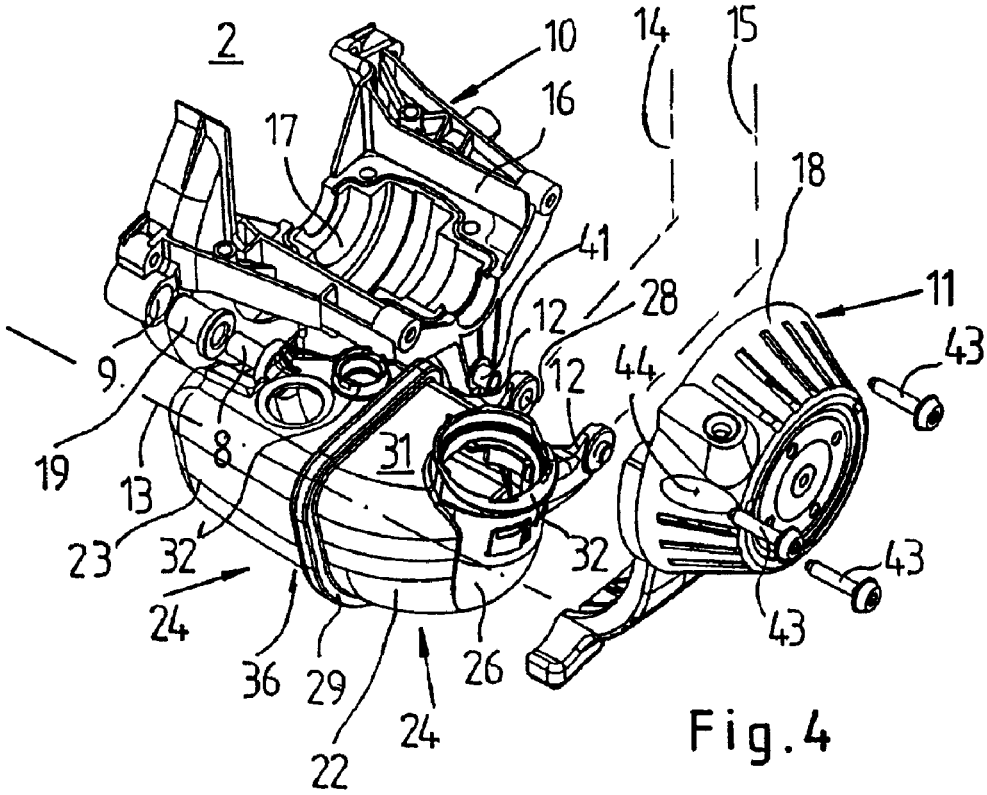
FIG. 4 is a perspective exploded view of the tank of FIG. 3.
Figure 5:
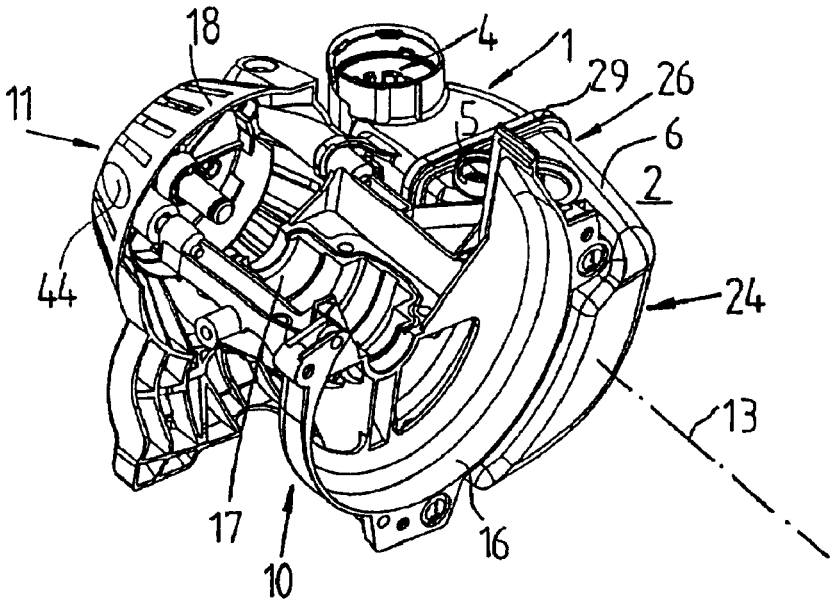
FIG. 5 is a perspective view of the tank in the direction of arrow V in FIG. 3.
Figure 6:
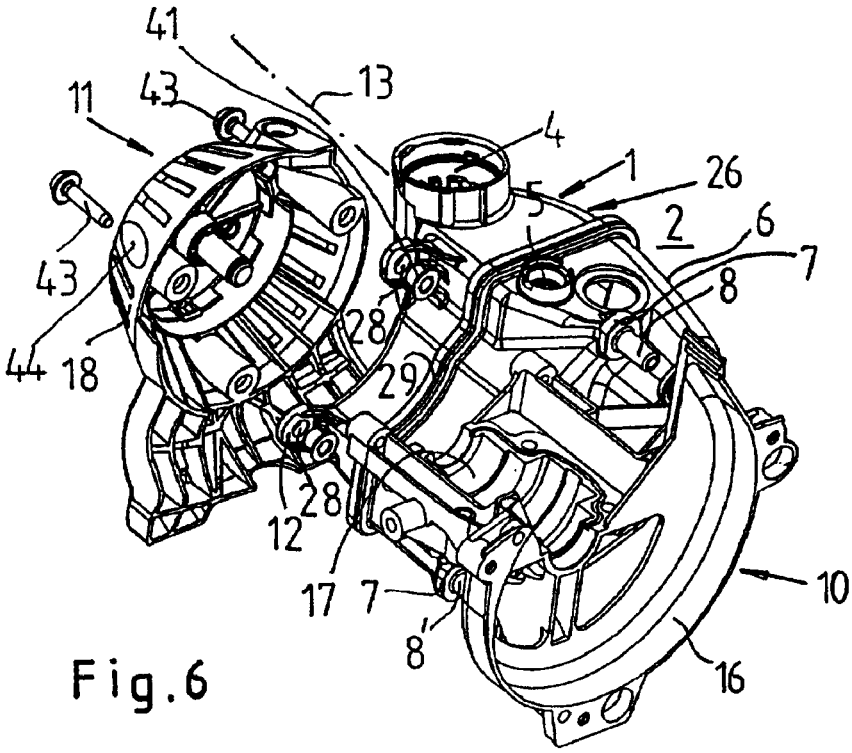
FIG. 6 is a perspective exploded view of the tank of FIG. 5.

To provide for a simple preaseembly of the tank 1 on the drive unit, it is a feature of the invention to form from the housing wall 6 of the tank 1 a pedestal or base 7 having a lug 8 as one piece. The lug 8 projects out from the base 7. In the embodiment shown in FIG. 1, two cylindrically-shaped lugs or studs (8, 8') are mounted on the housing wall 6 of the tank 1. The axial lengths of the lugs (8, 8') are approximately twice as large as their diameters. The lug 8, which is mounted in the region of the upper end 31 of the tank, and the lug 8' project with their respective bases 7 into a plane 20 from the housing wall 6. The lug 8' is arranged in the region of the base 36 of the tank 1 and the plane 20 is disposed transversely to the longitudinal center axis 13. The lugs (8, 8') are arranged with a radial spacing (37, 37') from the longitudinal center axis 13 and with a radial spacing (27, 27') from the housing wall 6 so that they can be pushed into receptacles 9 of a housing part 10 of the drive unit 2 as shown in FIGS. 3, 4 and 6. In the embodiment shown, the receptacles 9 are cylindrically-shaped openings in an engine housing 16, especially a crankcase 17.

Figure 2:
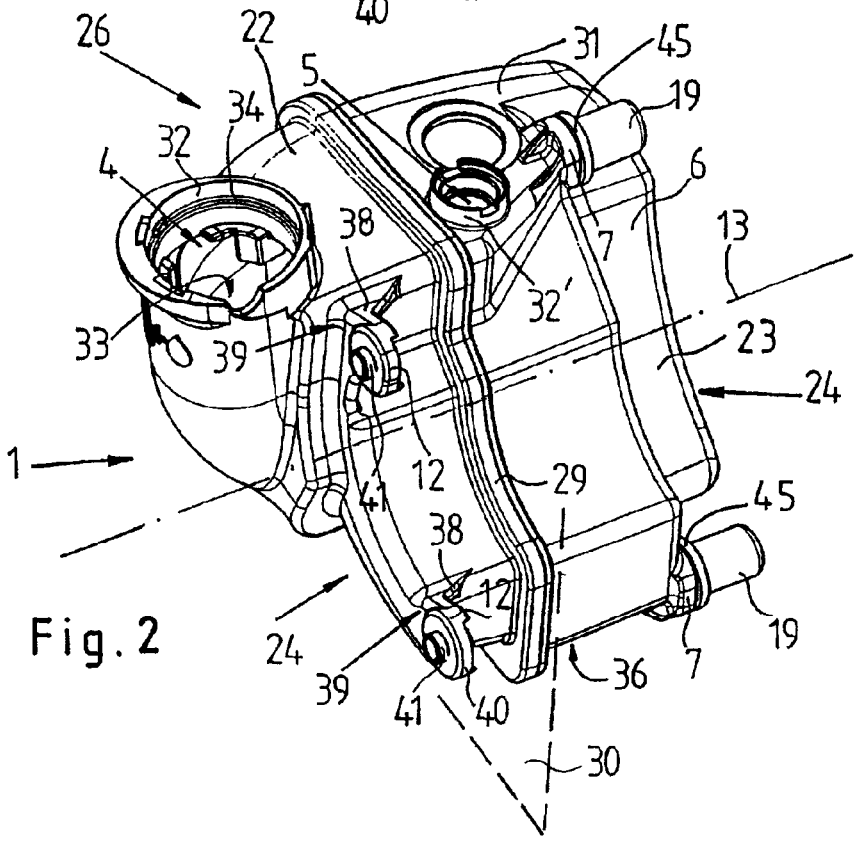
FIG. 2 is a perspective view of the tank of FIG. 1 shown in the condition ready for assembly.

The housing part 11 is formed as a truncated conically-shaped thin walled starter housing cover 18 of the internal combustion engine 3. The operating medium tank 1 can be clamped via direct contact of its housing wall 6 between the two housing parts 10 and 11 as well as being provided with one or more holding arms 12 (preferably two holding arms) as shown in FIGS. 1 to 7. The holding arms 12 function to form-tightly and force-tightly connect the tank 1 to the drive unit 2. For this purpose, the holding arms 12 are formed in one piece on the housing wall 6 as flat lugs having feet 39 correspondingly reinforced by ribs 38. As shown in FIG. 4, the holding arms 12 lie in respective planes 14 and 15. The planes (14, 15) are aligned at a spacing to each other and are approximately perpendicular to the longitudinal center axis 13 of the tank 1. The holding arms 12 have ends 40 which are thickened axially and lie at a distance from the housing wall 6. Through bores 28 pass through the ends 40 transversely to the respective longitudinal axes of the holding arms. The through bores 28 or eyes function for receiving reinforcement sleeves 41 having a collar 42. The reinforcement sleeves 41 are made especially of metal. As shown in FIG. 2, the reinforcement sleeves 41 extend axially through the through bores 28 in the assembled condition. As FIGS. 4 and 6 show, the reinforcement sleeves 41 function to accommodate threaded bolts 43. The threaded bolts 43 are guided through holes 44 on the starter housing cover 18 and through the reinforcement sleeves 41 and into threaded bores 45 in the crankcase 17. In this way, the holding arms 12 are clamped and held between the starter housing cover and the crankcase (see FIGS. 3 and 5).

The tank 1 is formed of two half shells (22, 23) in an injection molding process and the lugs (8, 8') are formed as one piece on the second half shell 23 and the holding arms 12 are formed as one piece on the first half shell 22. For this reason, the lug and the holding arms can be configured to have almost any desired axial extent. To support the preassembly of the tank 1 to the crankcase 17 and for the elastic form-tight fixing of the lugs (8, 8') of the tank 1 in the receptacles 9, the diameter or the clear width of the receptacles 9 are selected greater than the lug diameters. In this way, elastic damping elements 19 can be mounted radially between the lugs (8, 8') and the receptacles 9.

FIGS. 1 and 2 show cylindrically-shaped sleeve-like damping elements 19 provided with a collar 45. These damping elements are pushed onto the lugs (8, 8') as shown in FIG. 2. The collar 45 comes to rest against the particular base 7 of a lug (8, 8') in the assembled condition. The outer diameter of the particular damping element 19 is so selected that the damping element 19 together with the particular lug (8, 8') can be pushed into the receptacle 9 with slight radial jamming of the damping element. In the assembled condition of the operating medium tank 1, the damping elements 19 prevent the tank from coming to rest between the housing parts (10, 11) of the drive unit 2 in a static unwanted manner or in an excessive axial and/or radial clamped state. It can be practical to configure the base 7 as a set break location to prevent leakage of the tank 1 when there is a possible tear of one or several lugs (8, 8').

It is understood that the foregoing description is that of the preferred embodiments of the invention and that various changes and modifications may be made thereto without departing from the spirit and scope of the invention as defined in the appended claims.

What is claimed is:

1. An operating medium tank for a drive unit including an internal combustion engine of a portable handheld work apparatus, said operating medium tank comprising:

a housing having a housing wall defining an interior for the operating medium;

said housing wall having a fill opening and an output opening formed therein;

a base on said housing wall and a stud extending from said base;

said base and said stud formed as one piece from said housing wall;

a receptacle on said drive unit for receiving said stud; and, said tank being configured to be releasably fixed on said drive unit by said stud being received from-tight in said receptacles.

2. The operating medium tank of claim 1, wherein said drive unit includes first and second housing parts; and, said tank is fixedly mounted between said first and second housing parts.

3. The operating medium tank of claim 2, further comprising a holding arm formed on said housing wall as one piece therewith and said holding arm projecting from said housing wall.

4. The operating medium tank of claim 2, wherein said tank defines a longitudinal axis and further comprises a plurality of holding arms each formed on said housing wall as one piece therewith; and, said holding arms are disposed in respective planes disposed transversely to said longitudinal center axis.

5. The operating medium tank of claim 4, wherein said holding arms are fixed between said first and second housing parts when said tank is mounted on said drive unit.

6. The operating medium tank of claim 5, wherein said first and second housing parts conjointly define a motor housing.

7. An operating medium tank for a drive unit including an internal combustion engine of a portable handheld work apparatus, said operating medium tank comprising:

a housing having a housing wall defining an interior for the operating medium;

said housing wall having a fill opening and an output opening formed therein;

a base on said housing wall and a lug extending from said base;

said base and said lug formed as one piece from said housing wall;

a receptacle on said drive unit;

means for releasably fixing said tank with said lug to said receptacle so as to permit said tank to be mounted form-tight on said drive unit;

said drive unit including first and second housing parts; and, said tank being fixedly mounted between said first and second housing parts;

said tank defining a longitudinal axis and further comprising a plurality of holding arms each formed on said housing wall as one piece therewith; and, said holding arms being disposed in respective planes disposed transversely to said longitudinal center axis;

said holding arms being fixed between said first and second housing parts when said tank is mounted on said drive unit;

said first and second housing parts conjointly defining a motor housing; and, said first housing part being a crankcase and said second housing part being a starter housing cover.

8. The operating medium tank of claim 2, further comprising an elastic damping element mounted radially between said stud and said receptacle.

9. The operating medium tank of claim 2, further comprising an elastic damping element mounted radially and axially between said stud and said receptacle.

10. The operating medium tank of claim 1, wherein said tank defines a longitudinal center axis; and, said stud lies at a distance radially to said longitudinal center axis and said housing wall.

11. The operating medium tank of claim 10, wherein a plurality of said studs are formed on said housing wall as one piece therewith.

12. The operating medium tank of claim 11, wherein said studs are each formed on said housing wall as one piece therewith in a plane aligned transversely to said longitudinal center axis.

13. The operating medium tank of claim 4, wherein each of said holding arms defines a holding arm longitudinal axis; and, each of said holding arms has a through bore formed therein transverse to said holding arm longitudinal axis thereof.

14. The operating medium tank of claim 4, wherein said tank is made of thermoplastic plastic.

15. The operating medium tank of claim 14, wherein said thermoplastic plastic is polyamide.

16. The operating medium tank of claim 14, wherein said tank comprises first and second half shells; said half shells are formed as injection-molded parts or pressed parts; and, said first and second half shells are connected to each other by a friction weld.

17. An operating medium tank for a drive unit including an internal combustion engine of a portable handheld work apparatus, said operating medium tank comprising:

a housing having a housing wall defining an interior for the operating medium;

said housing wall having a fill opening and an output opening formed therein;

a base on said housing wall and a lug extending from said base;

said base and said lug formed as one piece from said housing wall;

a receptacle on said drive unit;

means for releasably fixing said tank with said lug to said receptacle so as to permit said tank to be mounted form-tight on said drive unit;

said drive unit including first and second housing parts; and, said tank being fixedly mounted between said first and second housing parts;

said tank defining a longitudinal axis and further comprising a plurality of holding arms each formed on said housing wall as one piece therewith; and, said holding arms being disposed in respective planes disposed transversely to said longitudinal center axis;

said tank being made of thermoplastic plastic;

said tank comprising first and second half shells; said half shells being formed as injection-molded parts or pressed parts; and, said first and second half shells being connected to each other by a friction weld;

said holding arms being formed on said first half shell; and, wherein said tank comprises a plurality of said lugs formed on said second half shell as one piece therewith.

18. The operating medium tank of claim 1, wherein said base is formed as a set break location between said housing wall and said stud.

19. The operating medium tank of claim 1, wherein said tank is a fuel tank.

20. The operating medium tank of claim 1, wherein said base is a portion raised from said housing wall in the manner of a pedestal and said stud extends from said pedestal; and, said pedestal, said stud and said wall all are formed as one piece.

* * * * *

UNITED STATES PATENT AND TRADEMARK OFFICE

CERTIFICATE OF CORRECTION

PATENT NO. : 6,905,042 B2 
DATED : June 14, 2005
INVENTOR(S) : Maximilian Eberhardt, Georg Becker and Juergen Haeberlein It is certified that error appears in the above-identified patent and that said Letters Patent is hereby corrected as shown below:

Title page,
Item [75], Inventors, delete "Háberlein" and substitute -- Häberlein -- therefor.

Column 3,
Line 41, delete "preaseembly" and substitute -- preassembly -- therefor.

Column 4,
Line 66, delete "from-tight" and substitute -- form-tight -- therefor.

Signed and Sealed this

Twenty-third Day of August, 2005

JON W. DUDAS
*Director of the United States Patent and Trademark Office*